US006345734B2

(12) United States Patent
Schalow et al.

(10) Patent No.: US 6,345,734 B2
(45) Date of Patent: Feb. 12, 2002

(54) DISPENSER FOR VISCOUS LIQUID AND FLEXIBLE VISCOUS LIQUID CONTAINING BAG

(75) Inventors: Stephan M. Schalow, Leola; Gary S. Rehm; Scott N. Rehm, both of Lititz, all of PA (US)

(73) Assignee: Major Smith, Inc., New Holland, PA (US)

( * ) Notice: Subject to any disclaimer, the term of this patent is extended or adjusted under 35 U.S.C. 154(b) by 0 days.

(21) Appl. No.: 09/862,629

(22) Filed: May 22, 2001

Related U.S. Application Data

(63) Continuation of application No. 09/506,639, filed on Feb. 18, 2000, now Pat. No. 6,273,297.

(51) Int. Cl.[7] ..... B65D 35/00

(52) U.S. Cl. ..... 222/103; 222/93; 222/95; 222/187.2

(58) Field of Search ..... 272/93, 95, 101–103, 272/105, 187.2, 209, 212–215

(56) References Cited

U.S. PATENT DOCUMENTS

| | | | | | |
|---|---|---|---|---|---|
| 1,556,437 | A | | 10/1925 | Granger | |
| 1,799,678 | A | * | 4/1931 | Devlin | 222/103 |
| 1,861,528 | A | | 6/1932 | Hadden | |
| 2,543,667 | A | | 2/1951 | Palmer | |
| 2,570,755 | A | | 10/1951 | Booth | |
| 2,670,876 | A | * | 3/1954 | Clouse | 222/102 |
| 2,766,908 | A | * | 10/1956 | Wheeler | 222/103 |
| 2,837,243 | A | | 6/1958 | Zebnik | |
| 2,936,006 | A | | 5/1960 | Henley | |
| 3,199,736 | A | | 8/1965 | Smith | |
| 3,741,439 | A | | 6/1973 | Vehrs | |
| 3,780,911 | A | | 12/1973 | Paige | |
| 3,894,381 | A | | 7/1975 | Christine et al. | |
| 4,223,809 | A | | 9/1980 | Martin | |
| 4,226,336 | A | | 10/1980 | Young | |
| 4,246,062 | A | | 1/1981 | Christine | |
| D260,817 | S | | 9/1981 | Christine | |
| D262,658 | S | | 1/1982 | Christine | |
| 4,332,122 | A | | 6/1982 | Williams | |
| 4,349,133 | A | | 9/1982 | Christine | 222/207 |
| 4,362,255 | A | | 12/1982 | Bond | |
| 4,418,840 | A | * | 12/1983 | Gardner, Sr. | 222/102 |
| 4,448,329 | A | | 5/1984 | Vilaseca et al. | |
| 4,452,378 | A | | 6/1984 | Christine | |
| 4,551,139 | A | * | 11/1985 | Plaas et al. | 222/105 |
| 4,570,827 | A | | 2/1986 | Roggenburg, Jr. et al. | |
| 4,601,410 | A | | 7/1986 | Bond | |
| 4,603,536 | A | | 8/1986 | de la Poype | |
| 4,654,240 | A | | 3/1987 | Johnston | |
| 4,686,125 | A | | 8/1987 | Johnston et al. | |
| 4,711,373 | A | | 12/1987 | Christine | |
| 4,717,047 | A | | 1/1988 | van Overbruggen et al. | |
| 4,744,845 | A | | 5/1988 | Posey | |
| 4,761,197 | A | | 8/1988 | Christine et al. | |
| 4,767,478 | A | | 8/1988 | Christine | |
| 4,783,947 | A | | 11/1988 | Posey et al. | |

(List continued on next page.)

*Primary Examiner*—J. Casimer Jacyna
(74) *Attorney, Agent, or Firm*—Volpe and Koenig, P.C.

(57) ABSTRACT

A dispenser for dispensing viscous liquid from a flexible viscous liquid containing bag having a dispensing opening is provided. The dispenser includes a support plate that is adapted to support the flexible viscous liquid containing bag. A squeegee carriage having a squeegee attached thereto is also provided. The squeegee carriage is mounted for movement from an initial, upper position downwardly along the support plate to a lower position. The squeegee is adapted to press the flexible viscous liquid containing bag against the support plate to squeeze the viscous liquid from the dispensing opening. A flexible bag for use with the dispenser is also provided.

16 Claims, 5 Drawing Sheets

U.S. PATENT DOCUMENTS

| | | | | |
|---|---|---|---|---|
| 4,790,815 | A | | 12/1988 | Balteau et al. |
| 4,792,373 | A | | 12/1988 | Hsei et al. |
| 4,796,788 | A | | 1/1989 | Bond |
| 4,801,050 | A | | 1/1989 | Bell |
| 4,921,139 | A | | 5/1990 | Fischer et al. |
| 5,000,350 | A | | 3/1991 | Thomsen |
| D318,795 | S | | 8/1991 | Christine |
| 5,102,015 | A | | 4/1992 | Barnard et al. |
| 5,242,083 | A | | 9/1993 | Christine et al. |
| 5,292,031 | A | | 3/1994 | Dagan |
| 5,356,039 | A | | 10/1994 | Christine et al. |
| 5,390,814 | A | | 2/1995 | Christine et al. |
| 5,425,475 | A | * | 6/1995 | Clark ..... 222/103 |
| 5,564,591 | A | | 10/1996 | Christine et al. |
| 5,634,343 | A | | 6/1997 | Baker, III |
| 5,647,511 | A | | 7/1997 | Bond |
| 5,676,279 | A | | 10/1997 | Vehrs |
| 5,680,970 | A | | 10/1997 | Smith et al. |
| 5,833,120 | A | * | 11/1998 | Evans, Sr. et al. ..... 222/95 |
| 5,845,813 | A | | 12/1998 | Werner |
| 6,024,252 | A | | 2/2000 | Clyde |
| 6,105,821 | A | | 8/2000 | Christine et al. |
| 6,196,420 | B1 | | 3/2001 | Gutierrez et al. |

* cited by examiner

FIG. 8
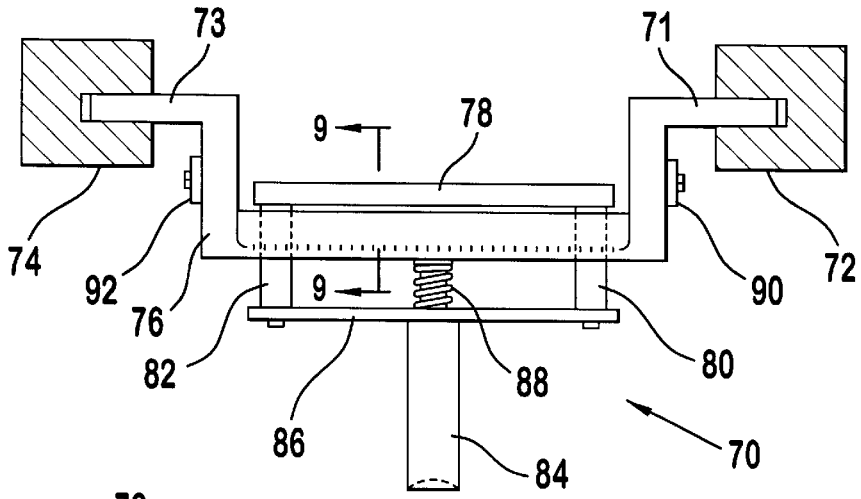
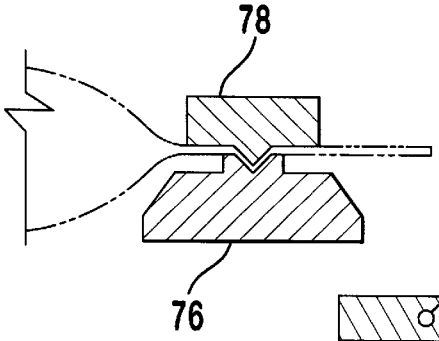
FIG. 9
FIG. 10
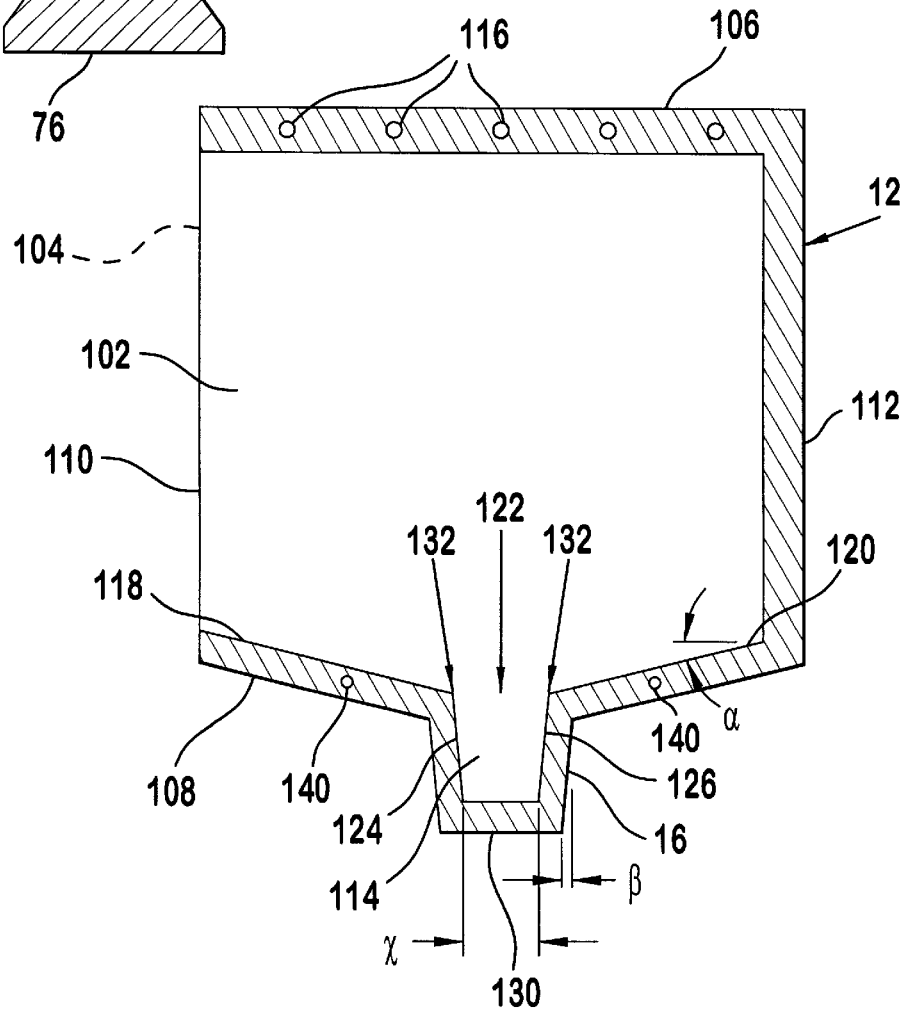

DISPENSER FOR VISCOUS LIQUID AND FLEXIBLE VISCOUS LIQUID CONTAINING BAG

CROSS REFERENCE TO RELATED APPLICATION

This application is a continuation of U.S. patent application Ser. No. 09/506,639, filed Feb. 18, 2000, now U.S. Pat. No. 6,273,297, entitled "Dispenser For Viscous Liquid And Flexible Viscous Liquid Containing Bag."

BACKGROUND

The present invention relates to an apparatus for dispensing viscous liquid from a flexible viscous liquid containing bag as well as the flexible bag itself, and more particularly, to a dispenser for viscous liquid food products which may be heated, such as cheese.

In the food service industry, it is often desirable to serve viscous food products which may be served at room temperature, such as ketchup, or which may be served at an elevated temperature, such as a cheese for nacho chips or other foods. It has been known to provide such products, including cheese, in flexible bags. The product must then be somehow dispensed or warmed and somehow dispensed from the bags. Numerous systems have previously been employed for dispensing food products. One prior known apparatus utilized a flexible container having a separately attached dispensing fitment for dispensing the food product. A hose is provided on or attached to the fitment and engaged in a peristaltic pump in order to pump product from the container. However, utilizing such an apparatus leaves a substantial amount of food product in the container which is not dispensed and is eventually disposed of when the majority of the food product has been dispensed from the container. Such systems often have waste rates of ten to fifteen percent or more of the food product which is not dispensed from the container and often require threading the hose from a new bag through the pump arrangement which adds complexity to both the mechanism as well as the task of replacing the disposable food product container.

Another known system utilizes a hanging bag which is suspended generally vertically in a heated chamber. A hose is connected to a fitment located on the bag and is pinched off by an "iron utter" clamping apparatus to control dispensing. Gravity influenced squeeze bars which are located a fixed distance from one another are placed over the bag to move cheese toward the bag outlet fitment for dispensing. While this provides an improvement in the amount of cheese dispensed from the flexible bag container, some of the cheese food product remains in the bag due to the fixed distance between the bars.

It would be desirable to provide a dispenser and a flexible bag for use in connection with such dispenser which provides for both simple operation and is reliable in use for dispensing substantially all of a viscous product from the flexible bag, and in particular for dispensing all of a viscous food product from the bag. The dispenser and apparatus also preferably provide for more economical packaging and dispensing of the viscous liquid product.

SUMMARY

Briefly stated, the present invention provides a dispenser for dispensing a viscous liquid from a flexible viscous liquid containing bag having a dispensing opening. The dispenser includes a support plate. The support plate is adapted to support the flexible viscous liquid containing bag. A squeegee carriage having a squeegee attached thereto is also provided. The squeegee carriage is mounted for movement from an initial, upper position downwardly along the support plate to a lower position. The squeegee is adapted to press the flexible viscous liquid containing bag against the support plate to squeeze the viscous liquid from the dispensing opening.

In another aspect, the present invention provides a dispenser for dispensing a viscous liquid from a flexible viscous liquid containing bag having a dispensing opening. The dispenser includes a support plate positioned at an angle of approximately 90° or less. The support plate is adapted to support the flexible viscous liquid containing bag. A squeegee carriage having a squeegee attached thereto is also provided. The squeegee carriage is mounted for movement from an initial, upper position downwardly along the support plate to a lower position by gravity acting on the squeegee carriage. The squeegee is preferably oriented generally horizontally and is adapted to press the flexible viscous liquid containing bag against the support plate to squeeze the viscous liquid from the dispensing opening.

In another aspect, the present invention provides a combination of a dispenser for dispensing a viscous liquid food product from a flexible viscous liquid containing bag and a flexible bag containing the viscous liquid food product. The dispenser includes a support plate. A squeegee carriage having a squeegee attached thereto is also provided. The squeegee carriage is mounted for movement between an initial, upper position downwardly along the support plate to a lower position. The squeegee is adapted to press against the support plate. The bag comprises two flexible sides connected together around a periphery of the sides. The periphery includes a top edge, a bottom edge and two side edges. The bottom edge includes an integrally formed spout formed by the flexible sides with an outlet opening defined on a free end thereof. The dispenser further includes a connector for connecting the bag to the support plate such that the bag is supported by the support plate with the bottom of the bag including the integrally formed spout located in proximity to the bottom of the support plate. The squeegee presses the two flexible sides of the bag against one another and the support plate as the squeegee carriage moves downwardly from the initial, upper position to squeeze the viscous liquid food product from the outlet opening.

The present invention also provides an integral nozzle flexible bag for storing and dispensing a viscous liquid. The bag includes two flexible sides connected together around a periphery of the sides. The periphery includes a top edge, a bottom edge and two side edges. The bottom edge includes an integrally formed spout formed by the flexible sides. The bottom edge of the bag further includes two seam lines which extend inwardly from the side edges and downwardly toward the bottom of the bag. The angled seam lines terminate at medial positions spaced apart from one another to define a spout entrance. Two downwardly extending spout forming seam lines extend from the terminating medial positions of the angled seam lines to define the integrally formed spout. A spout closure seam line is defined along a bottom of the spout.

BRIEF DESCRIPTION OF THE DRAWING(S)

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 8 is a top view of the valve assembly of FIG. 7;

FIG. 9 is a cross-sectional view taken along lines 9—9 in FIG. 8;

FIG. 10 is an elevational view of a preferred embodiment of the flexible viscous liquid containing bag utilized with the dispenser in accordance with the present invention;

DETAILED DESCRIPTION OF THE PREFERRED EMBODIMENT(S)

Figure 1:
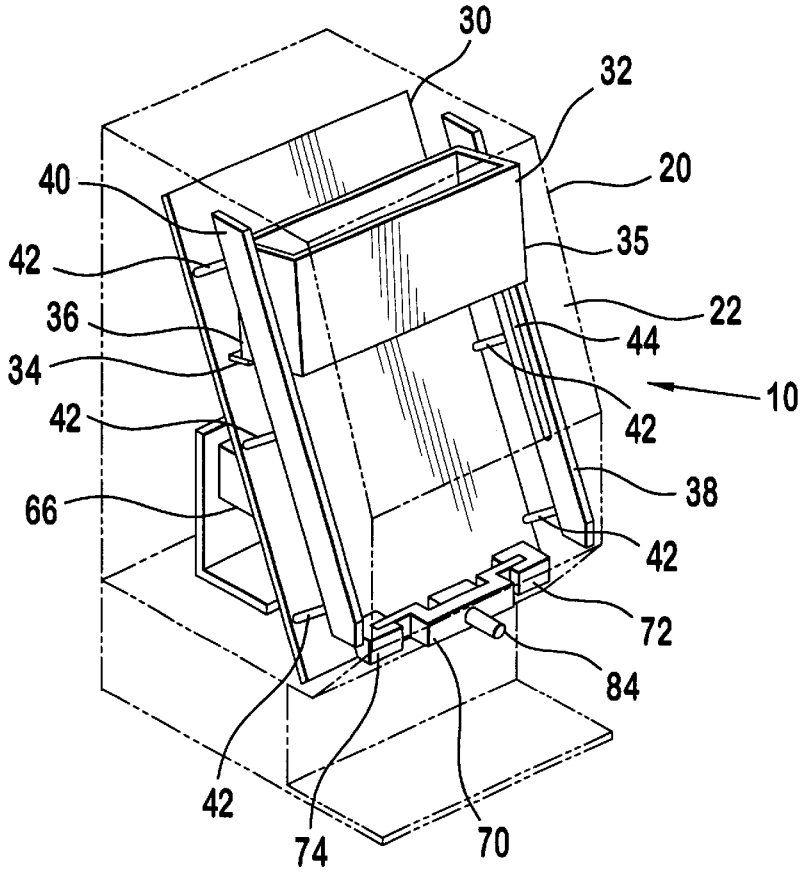
FIG. 1 is a perspective view of a dispenser in accordance with the present invention, with the dispenser housing being shown in phantom lines.

Certain terminology is used in the following description for convenience only and is not limiting. The words "right," "left," "lower," and "upper" designate directions in the drawings to which reference is made. The words "inwardly" and "outwardly" refer to directions towards and away from, respectively, the geometric center of the dispenser in accordance with the present invention, and designated parts thereof. The terminology includes the words noted above as well as derivatives thereof and words of similar import.

Figure 11:
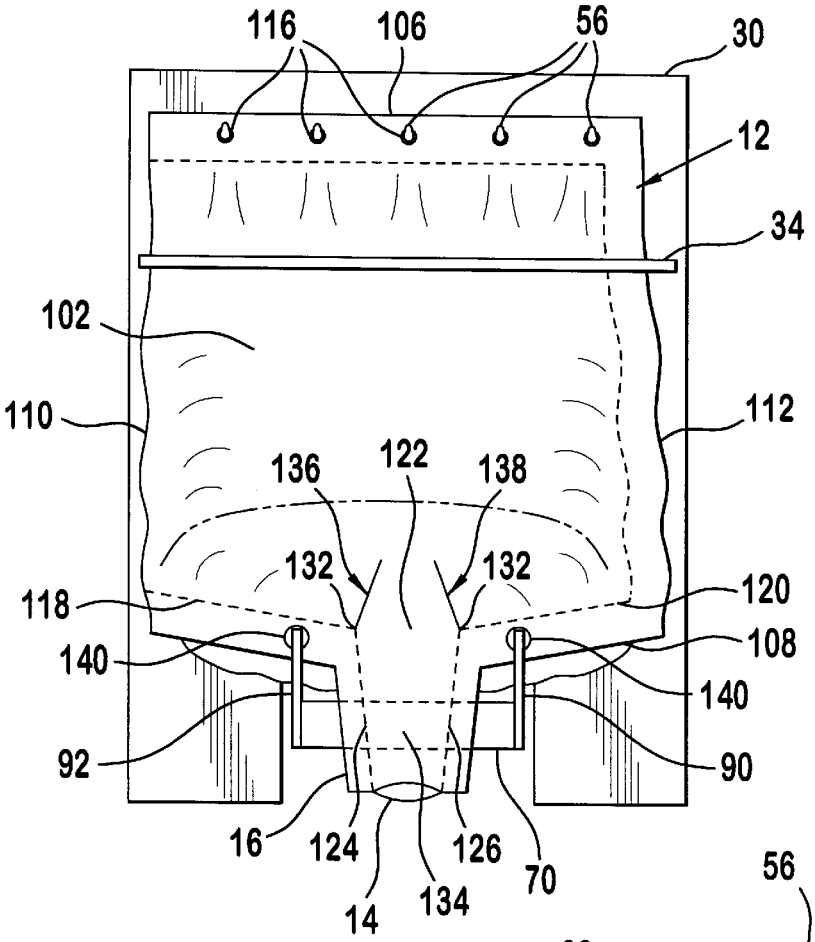
FIG. 11 is a front elevational view illustrating the flexible viscous liquid containing bag in an installed position on the support plate of the dispenser of FIG. 1 showing the crease forming transition area of the bag which create the flow channel through the spout.

Referring now to FIGS. 1–6, a dispenser 10 for dispensing a viscous liquid from a flexible viscous liquid containing bag 12, shown in FIGS. 9–11, is provided. The bag 12 which is described in detail below, includes a dispensing opening 14 for dispensing the viscous liquid contained therein.

Figure 2:
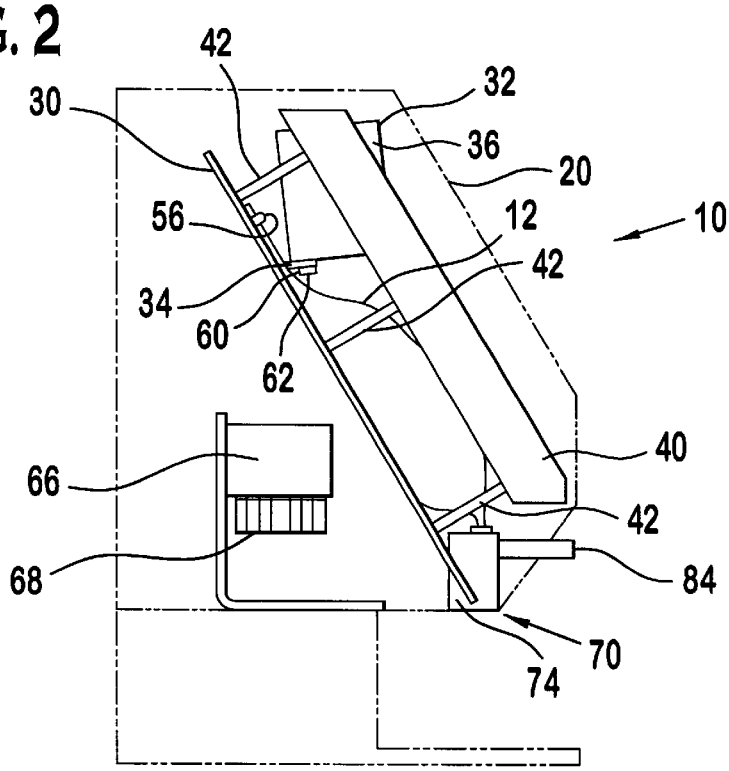
FIG. 2 is a side elevational view of the dispenser of FIG. 1.
Figure 3:
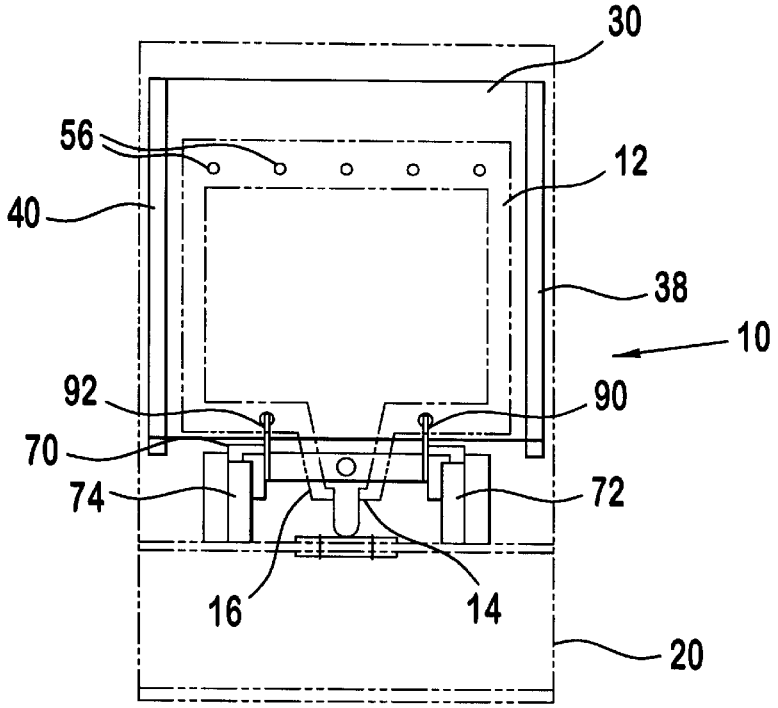
FIG. 3 is a front elevational view of the dispenser of FIG. 1.

As shown in FIGS. 1 and 2, preferably the dispenser 10 includes a housing 20 (shown in phantom lines). The specific construction of the housing 20 can be varied and is preferably made from a molded polymeric material. Preferably, the front 22 of the housing is hinged or otherwise easily removable to access the dispenser components located within the housing 20. It will be recognized by those skilled in the art from the present disclosure that the specific construction and materials utilized in making the housing 20 can be varied depending Upon the particular application for the dispenser 10.

Figure 4:
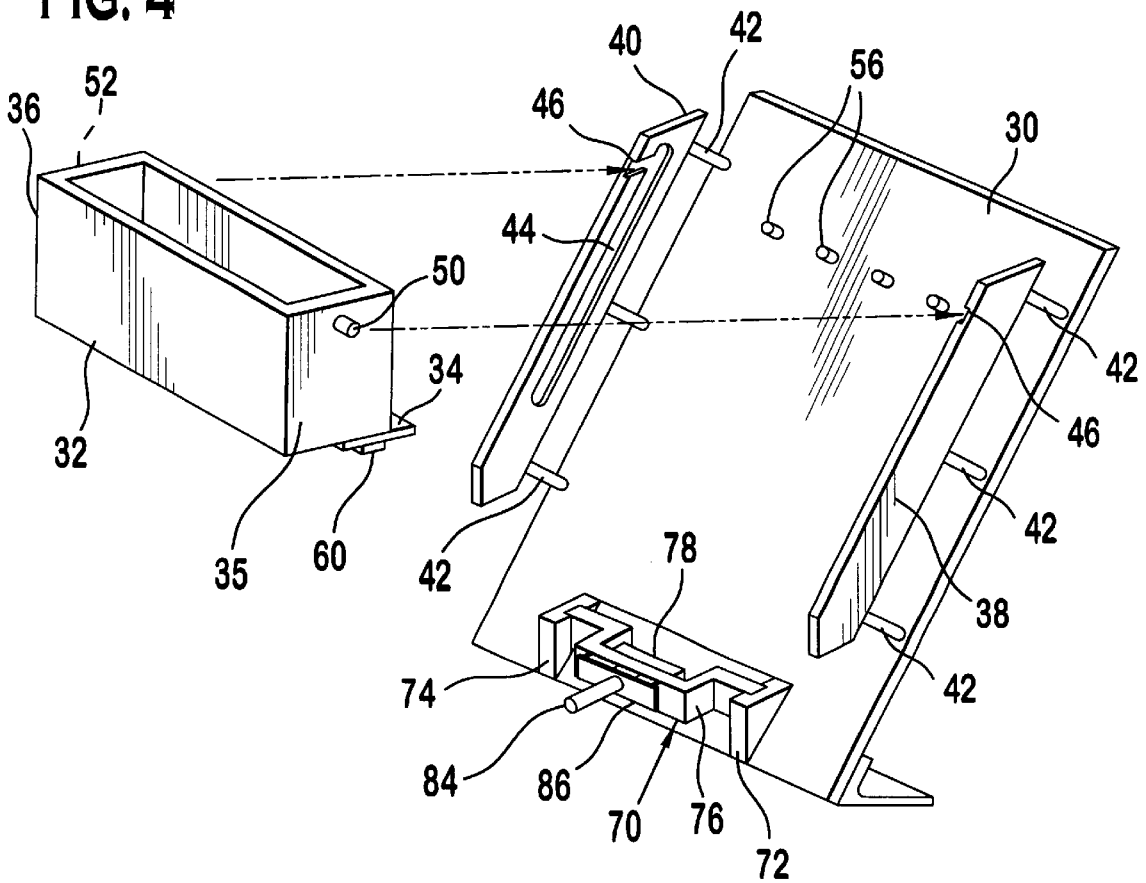
FIG. 4 is a perspective view, partially disassembled, of the squeegee carriage and support plate for the dispenser shown in FIG. 1.
Figure 5:
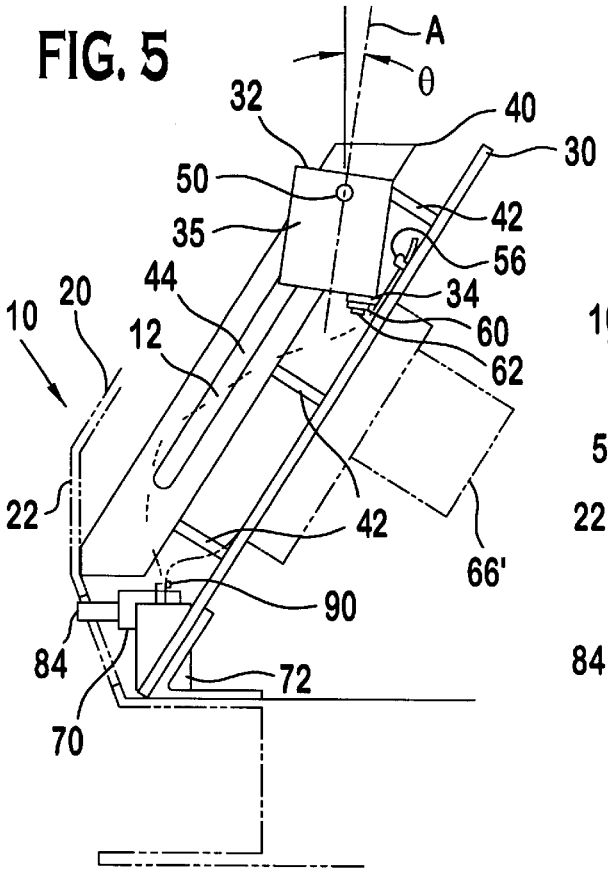
FIG. 5 is a side elevational view of the dispenser showing the squeegee carriage in an initial, uppermost position in the dispenser.
Figure 6:
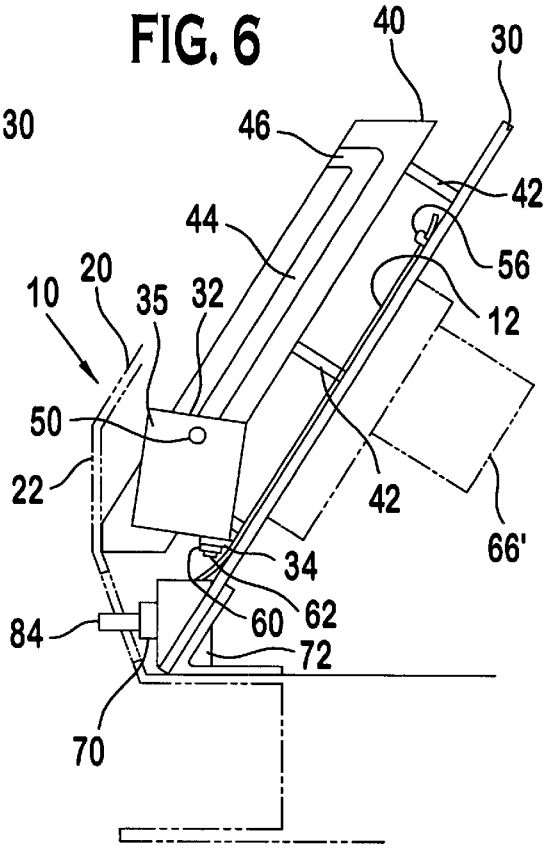
FIG. 6 is a side elevational view of the dispenser similar to FIG. 5 showing the squeegee carriage in a lower position with the viscous liquid product having been dispensed from the flexible viscous liquid containing bag.

Still with reference to FIGS. 1–6, a support plate 30 is positioned within the housing 20, preferably at an acute angle to the generally horizontally oriented base of the dispenser 10. The support plate 30 is adapted to support the flexible viscous liquid containing bag 12, as best shown in FIGS. 2, 5 and 6. Preferably, the support plate 30 is made of a rigid metallic material, such as aluminum or stainless steel. However, it will be recognized by those skilled in the art from the present disclosure that the support plate 30 can be made of any other suitable material, such as a molded plastic material, depending upon the particular dispenser construction and application.

As shown in FIGS. 1, 2 and 4, a squeegee carriage 32 having a squeegee 34 located thereon is positioned such that the squeegee 34 contacts the support plate 30 and/or the flexible viscous liquid containing bag 12 located thereon. As best shown in FIGS. 5 and 6, the squeegee carriage 32 is mounted for movement from an initial, upper position, as shown in FIG. 5, generally downwardly along the support plate 30 to a lower position by a gravity acting on the squeegee carriage 32. In the preferred embodiment, the squeegee 34 is oriented generally horizontally and is adapted to press the flexible viscous liquid containing bag 12 against the support plate 30 to squeeze the viscous liquid from the dispensing opening 14 of the bag 12. However, the squeegee 34 could be oriented at an angle, if desired. At least one guide 38 and preferably two guides in the form of guide rails 38, 40 are positioned generally parallel to the support plate 30. The squeegee carriage 32 is movably connected to the at least one guide 38 for guiding the movement of the squeegee carriage 32 downwardly along the support plate 30. The guide rails 38, 40 are preferably positioned generally along the longitudinal edges of the support plate 30. Preferably, the guide rails 38,40 are connected to the support plate 30 with standoff spacers 42. However, it will be recognized by those skilled in the art from the present disclosure that the guide rails 38, 40 could be configured such that the standoffs 42 are not required. For example, the guide rails 38, 40 could be formed integrally with the side walls of the housing 20.

As shown in detail in FIGS. 4 and 6, each guide rail 38, 40 includes a guide channel 44 which extends generally along the guide rail 38, 40. An entrance slot 46 is provided in proximity to the upper end of each guide rail 38, 40. As shown in detail in FIG. 4, the squeegee carriage 32 includes opposing projections 50, 52 which are insertable in the corresponding entrance slots 46 and movable in the guide channels 44 of the guide rails 38, 40. In the preferred embodiment, the guide rails 38, 40 are molded from a polymeric material, such as polyethylene or polypropylene. However, it will be recognized by those skilled in the art from the present disclosure that the guide rails 38, 40 could be made from other suitable materials and can be machined from aluminum or stainless steel, if desired. Additionally, the guide rails can be formed integrally with the housing 20. The squeegee carriage 32 is preferably also made of a polymeric material, but may be made of aluminum or stainless steel to provide additional weight for movement of the squeegee carriage 32 downwardly along the support plate 30. The sidewalls of the squeegee carriage 32 may be perforated to facilitate the flow of heated air around a spare bag in the carriage 32, if desired. The width of the squeegee carriage 32 preferably corresponds to the spacing between the guide rails 38, 40.

Referring now to FIGS. 2, 5 and 6, the specific orientation of the squeegee carriage 32 with respect to the support plate 30 of the preferred embodiment is explained in detail. As shown in detail in FIG. 5, the squeegee carriage 32 has a generally vertical axis A that extends through the pivot point of the carriage 32 and is inclined at an angle θ with respect to vertical when the squeegee carriage 32 is connected to the guide rails 38, 40 with the projections 50, 52 extending from the end surfaces 35, 36 of the squeegee carriage 32 engaged in the guide channels 44. This angle is preferably greater than 0° and more preferably between 3° and 20°. In the working embodiment of the invention, an angle θ of approximately 5°–6° has performed well. The angle θ is set such that gravity acting on the squeegee carriage 32 causing a force component to be reacted through the squeegee 34 against the support plate 30 which provides the squeezing action for removal of substantially all of the viscous liquid from the bag 12 as the viscous liquid is being dispensed. Accordingly, it is possible that the support plate 30 and squeegee carriage 32 could be arranged with the angle 0 being outside of the preferred ranges, as long as a force component is transmitted through the squeegee 34 and against the support plate 30. The angle θ can be adjusted by a number of means, including the adjustment of the length of the standoff spacers 42, the width of the squeegee 34, the height of the squeegee carriage 32 between the projections 50, 52 and the squeegee 34 as well as the angle of the support plate 30. Other adjustment possibilities also exist which will be readily understood by those skilled in the art from the present disclosure and have not been enumerated in detail herein.

It will also be recognized by those skilled in the art from the present disclosure that the angle θ need not remain constant and that the path of the guide channels 44 relative to the support plate 30 may be varied such that the angle θ varies depending upon the location of the squeegee carriage 32 along the guide rails 38, 40. Additionally, it will be similarly understood by those skilled in the art that while in the preferred embodiment of the support plate 30 is planer and the guide channels 44 in the guide rails 38, 40 are linear, that the support plate could be curved and the guide channels 38,40 similarly curved, depending upon the particular application.

As best shown in FIGS. 3–6, preferably mounting pins 56 are located on the support plate 30. The mounting pins 56 are adapted to connect the flexible viscous liquid filled bag 12 to the support plate 30. In the preferred embodiment, five mounting pins 56 are provided. However, it will be recognized by those skilled in the art from the present disclosure that fewer or more mounting pins 56 can be provided. Additionally, those skilled in the art will understand from the present disclosure that other means for connecting the bag 12 to the support plate 30 may be utilized, such as one or more clamps, hooks or other suitable connector elements which may be connected to the support plate 30 or the housing 20 such that the flexible viscous liquid filled bag 12 rests on the support plate 30.

The squeegee 34 is preferably removably connected to the squeegee carriage 32. This allows the squeegee 34 to be removed for replacement if needed. As shown in FIG. 5, the squeegee 34 can be removably attached to the squeegee carriage 32 utilizing a retainer 58 and threaded fasteners 60, if desired. Other clamping means may be provided or the squeegee 34 can be removably positioned within a channel or pocket (not shown) formed in the squeegee carriage 32.

Referring again to FIGS. 1 and 2, preferably a heater assembly 66 is located within the closure formed by the housing 20. The heater 66 is adapted to heat the viscous liquid in the flexible viscous liquid containing bag 12 for dispenser applications such as dispensing heated cheese or other heated food products, including chocolate sauce, gravy, etc. Preferably, the heater 66 includes a fan 68 for circulating heated air throughout the enclosure formed by the housing 20 and a thermostat to control the temperature. For cheese dispensing applications, the heater 66 is capable of heating the contents of the bag 12 to at least 140° F. and the thermostat is able to maintain the temperature at the desired level. Alternatively, as shown in FIG. 5, a heater unit 66' may be connected directly to the back of the support plate 30 to provide conductive heating of the support plate 30 as well as convective heating within the housing enclosure. In the preferred embodiment, the heater 66 is a unitary assembly which can be easily removed as a single unit for replacement, if necessary. Those skilled in the art will recognize that the heater 66 may be omitted depending upon the particular dispenser application.

In the preferred embodiment, the squeegee carriage 32 is configured as a spare flexible viscous liquid-filled bag 12 supporting basket. This allows the weight of a spare bag 12 filled with the viscous liquid to be dispensed to be utilized as part of the mass acted upon by gravity for driving the squeegee carriage 32 downwardly to dispense viscous liquid from the flexible viscous liquid containing bag 12 mounted on the support plate 30. In applications such as dispensing heated cheese, this also allows the spare flexible viscous liquid-filled bag 12 to be heated as the heated cheese is dispensed from the bag 12 located on the support plate 30. However, it will be recognized by those skilled in the art from the present disclosure that the squeegee carriage 32 need not be configured as a spare flexible viscous liquid bag holder, depending on the particular application.

As shown in FIGS. 1–6, a valve assembly 70 is provided on the dispenser 10. The valve assembly 70 is adapted to control the flow of the viscous liquid from the outlet opening 14, with the liquid being held under pressure due to the gravity driven squeegee carriage 32 acting on the bag 12. As shown in detail in FIGS. 5–7, the valve assembly 70 is mounted for movement to compensate for extension of the flexible viscous liquid containing bag 12 as the viscous liquid is dispensed. At least one valve guide 72, and preferably two valve guides 72, 74 are located in the dispenser 10. The valve assembly 70 is connected to the at least one valve guide 72, 74 in order to guide the valve assembly 70 during the bag extension movement. Preferably, the valve guides 72, 74 are constructed as generally vertical channels which receive a mating portion of the valve assembly 70 and guide the valve assembly 70 for generally vertical movement. However, those skilled in the art will recognize from the present disclosure that the channels need not be vertical. Additionally, depending upon the configuration of the bag 12, no movement of the valve assembly 70 may be necessary, and the valve assembly 70 can be located at a fixed position.

Figure 7:
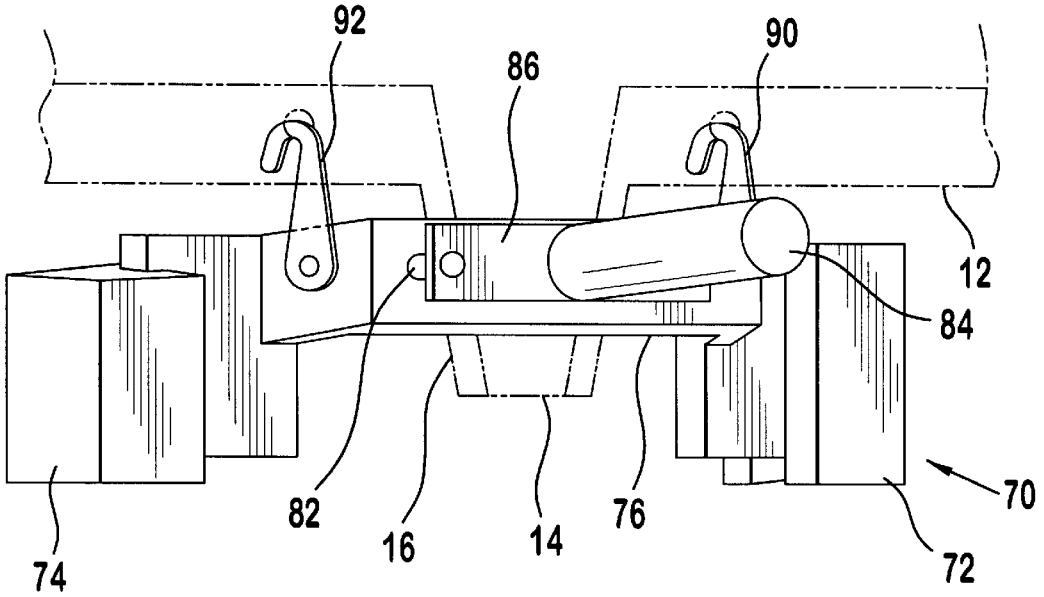
FIG. 7 is an enlarged perspective view of the valve assembly utilized in the dispenser of FIG. 1 which is mounted for generally vertical movement.

As shown in detail in FIGS. 7 and 8, preferably the valve assembly 70 includes a primary support member 76 having a generally hat-shaped cross section with legs 71 and 73, as shown most clearly in FIG. 8. Preferably, the first leg 71 has a greater thickness than the second leg 73 in order to ensure that the valve assembly 70 is correctly positioned in the valve guides 72, 74. A clamp bar 78 is position adjacent to the support 76 and mounted for movement on guide pins 80, 82 for movement toward and away from the primary support 76. An actuator button 84 is connected to the guide pins 80, 82 via a support member 86. A spring 88 is used to bias the support member 86 away from the primary support 76 such that the clamp 78 is biased toward the primary support 76 to a closed position of the valve assembly 70.

As shown in detail in FIG. 7, a nozzle 16 of the bag is inserted between the primary support 76 and the clamp bar 78 such that the nozzle 16 is clamped in a closed position until the actuator button 84 is pressed, moving the clamp bar 78 away from the primary support 76 to allow the flow of viscous liquid from the bag 12 through the nozzle 16. Those skilled in the art will recognize that other suitable types of valve assemblies may be utilized to prevent the flow of viscous liquid from the bag 12, if desired.

Still with reference to FIG. 7, the valve assembly 70 further includes at least one connector 90, and preferably two connectors in the form of hooks 90, 92, which is (are) adapted to connect the valve assembly 70 to the flexible viscous liquid containing bag 12. The hooks 90, 92 are preferably pivotably connected to the primary support 76 and can be engaged in corresponding apertures along the bottom edge of the bag 12. This maintains the nozzle 16 of the flexible bag 12 in position in the valve assembly 70.

A preferred clamping arrangement for clamping the nozzle 16 is shown in FIG. 9. In order to assure complete clamping of the nozzle 16, a V-shaped jaw arrangement is preferably used to provide multiple clamping points. The V-shaped jaw arrangement preferably includes a V-shaped protrusion 79 on the clamp bar 78 and a complementary shaped hollow jaw 77 on the primary support 76 of the valve assembly 70. while this arrangement is preferred, it will be recognized by those skilled in the art from the present disclosure that the specific shape of the jaw arrangement could be varied, if desired, or omitted with the clamping taking place between the mating faces of the primary support 76 and the clamp bar 78.

Figure 12:
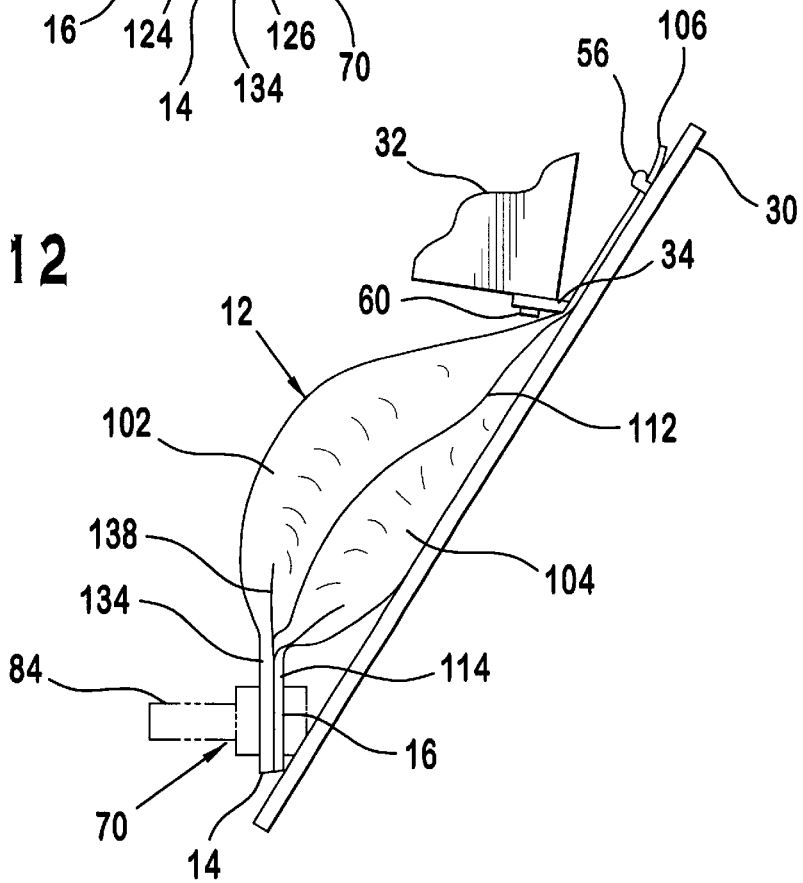
FIG. 12 is a side elevational view of the support plate and bag shown in FIG. 10.

Referring now to FIGS. 10–12, the flexible viscous liquid containing bag 12 will be described in detail. Preferably, the dispenser 10 is used in combination with the bag 12 which preferably contains a viscous liquid food product to be dispensed from the dispenser 10. The bag 12 includes two flexible sides 102, 104 which are connected together around a periphery. The periphery includes a top edge 106, a bottom edge 108 and two sided edges 110, 112. As shown in FIG. 10, the first side edge 110 is preferably formed by a fold between the two flexible sides 102, 104. The top edge 106, bottom edge 108 and second side 112 are preferably formed by heat sealing the flexible sides 102,104 together. The bottom edge 108 includes an integrally formed spout 114 formed by the flexible sides 102, 104 based upon the heat sealing arrangement between the flexible sides 102, 104, which preferably forms the nozzle 16. A mating connector attachment, preferably in the form of apertures 116 is located in the seal area along the top edge 106 of the bag 12. The apertures 116 may be in the form of perforations, slits or openings. The apertures 116 are adapted to be connected to the mounting pins 56 located on the support plate 30. This allows the bag 12 to be supported on the support plate 30 with the bottom of the bag 12 which includes the integrally formed spout 114 being located in proximity to the bottom of the support plate 30.

Referring again to FIGS. 7, 10 and 11, apertures 140 are formed along the bottom edge 108 of the bag for receiving the hooks 90, 92 from the valve assembly 70. The apertures 140 may also be in the form of slits, perforations or openings.

Referring in detail to FIG. 10, the bottom edge 108 of the bag 12 is defined by two seal lines 118, 120, which are preferably angled and extend inwardly from the side edges 110, 112 and downwardly toward the bottom of the bag 12. The seam lines 118, 120 terminate at medial positions spaced apart from one another to define a spout entrance 122. Two downwardly extending spout forming seam lines 124, 126 extend from the terminating medial positions of the seam lines 118, 120 to define the integrally formed spout 114. A spout closure seam line 130 is defined along the bottom of the spout 114 to seal the bag 12. The bottom of the spout 114 is cut off after the bag 12 is installed in the dispenser 10 such that the viscous liquid contained in the bag 12 can be dispensed through the spout 16.

In the preferred embodiment, the seam lines 118, 120 are oriented at an angle $\alpha$ approximately 15° downwardly. However, those skilled in the art will recognize from the present disclosure that the angle a can be varied to different angles depending the volume of material to be contained in the bag and the viscosity of the material. Preferably, the angle $\alpha$ will be at least 3°, and more preferably will be between 10° and 20°. Alternatively, the seam lines 118, 120 could be formed as a radius. The downwardly extending spout seam lines 124, 126 are oriented at an angle $\beta$ from vertical. In the preferred embodiment, the angle $\beta$ is preferably between about 3° and about 10° and more preferably is approximately 5°. However, it will be recognized by those skilled in the art from the present disclosure that any suitable angle could be utilized. As shown in FIG. 9, preferably the angled seams line 118, 120 each intersect the corresponding spout forming seam line 124, 126 at a point to define a crease forming transition area 132 which functions to create a flow channel 134 when the bag 12 is positioned on the support plate 30 and the spout 114 is oriented generally downwardly as shown in FIGS. 10 and 11. The crease forming transition area 132 is characterized by creases 136, 138 which propagate from the intersection of the angled seam lines 118, 120 and the corresponding downwardly extending seam lines 124, 126. During experimentation with different bag configurations, it was found bags having a radiused intersection at the crease forming transition area 132 generally caused the spout to fold flat, cutting off flow of product from the bag 12 due to the failure to creature a flow channel 134. Although a small radius may be utilized to the extent that creases are formed which extend from the crease forming transition area 132, larger radiused intersections have failed to develop such creases in the transition area 132 in use.

Those skilled in the art will recognize that the specific bag configuration for use in connection with the dispenser 10 can be varied, if desired, and it is not necessary to utilize a bag 12 having a nozzle 16 in the form of the integral spout 114 as described above, and a separate fitment for connecting a nozzle could be provided, if desired. However, cost advantages are provided by having an integral nozzle bag 12 in connection with the present invention.

To use the dispenser 10 in accordance with the present invention, a bag 12 containing a viscous liquid is connected to the mounting pins 56 on the support plate 30 with the bottom edge 108 of the bag extending downwardly such that the spout 114 can be placed between the clamp bar 78 and the primary support 76 of the valve assembly 70. Hooks 90, 92 from the valve assembly 70 are connected to the bottom edge of the bag. Once the bag 12 is connected to the support plate 30 with the spout 114 extending through the valve assembly 70, the spout closure seam 130 is cut off such that the spout 114 is only held in the closed position by the valve assembly 70. The squeegee carriage 32 is then installed over the bag 12 by aligning the projections 50, 52 with the entrance slots 46 in the guide rails 38, 40 as shown in FIG. 4. With the squeegee carriage 32 positioned as shown in FIG. 5, it is then possible to dispense viscous liquid from the bag 12 by pushing the actuator button 84 to open the valve assembly 70 such that viscous liquid flows through the spout 114 and out the dispensing opening 14. The squeegee carriage 32 moves downwardly along the support plate 30 such that the squeegee 34 presses the flexible sides 102, 104 of the bag 12 against one another and against the support plate 30 as the squeegee carriage 32 moves downwardly to squeeze the viscous liquid out of the bag 12 through the outlet opening 14. When the actuator button 84 of the valve assembly 70 is released, the flow of liquid from the bag 12 is halted and downward movement of the squeegee 34 on the squeegee carriage 32 is stopped due to the trapped volume of viscous liquid still remaining in the bag 12.

As the viscous liquid is dispensed from the bag 12, the squeegee carriage 32 moves downwardly along the support plate 30 and the bag 12 elongates. This elongation, which is due to the flattening of the bag as the product is dispensed, is accommodated by the valve assembly 70 moving downwardly in the valve guide 72, 74.

Preferably, when the dispenser 10 is used in connection with dispensing heated cheese, a second replacement bag 12 of the cheese product is placed in the squeegee carriage 32. This provides extra mass for the squeegee carriage 32 which is acted upon by gravity to drive the squeegee carriage 32 downwardly along the support plate 30. Additionally, this allows the second bag 12 of the cheese product to be preheated as the cheese material from the first bag 12 is dispensed.

As shown by a comparison of FIGS. 5 and 6, as the product is dispensed from the bag 12 and the valve assembly 70 moves downwardly, the actuator button 84 also moves downwardly. Appropriate provisions, such as a slot through the housing 20 or the door 22 which comprises the front of the housing 20 are preferably provided to accommodate this movement.

Through the use of the support plate 30 and the squeegee carriage 32, a wiping or squeegee action is provided which removes substantially all of the viscous liquid product in the bag 12 during dispensing operations. This provides for increased profitability and reduced loss due to the inability to remove substantially all of the viscous liquid from the bag as in the prior known dispensers. The present dispenser 10 is also ideal for unskilled operators due to the simplicity of the mechanism.

It will be appreciated by those skilled in the art that changes can be made to the embodiments described above without departing from the broad inventive concept thereof. It is understood, therefore, that the invention is not limited to the particular embodiments disclosed, but is intended to cover modifications within the scope and spirit of the present invention.

What is claimed is:

1. A dispenser for dispensing a viscous liquid from a flexible viscous liquid containing bag having a dispensing opening, the dispenser comprising:

a support plate adapted to support the flexible viscous liquid containing bag; and a carriage having an edged member attached thereto, the carriage being gravity driven and mounted to move from an initial, upper position downwardly along the support plate to a lower position so that, when the flexible viscous liquid containing bag is located on the support plate, the edged member is in free pressing engagement with the flexible viscous liquid containing bag to constantly maintain the flexible viscous liquid containing bag under pressure by effect of a weight of the carriage causing the edged member to press the flexible viscous liquid containing bag against the support plate to squeeze the viscous liquid toward the dispensing opening.

2. The dispenser of claim 1, wherein the edged member is mounted generally horizontally.

3. The dispenser of claim 1, further comprising an enclosure surrounding the support plate and the carriage, and a heater located within the enclosure, the heater being adapted to heat the viscous liquid in the flexible viscous liquid containing bag.

4. The dispenser of claim 1, further comprising at least one uninterrupted guide positioned generally parallel to the support plate, the carriage being movably connected to the at least one uninterrupted guide.

5. The dispenser of claim 4, wherein the support plate includes two longitudinal edges, the at least one uninterrupted guide comprises two guide rails, each guide rail being positioned generally along a separate one of the longitudinal edges of the support plate.

6. The dispenser of claim 5, wherein each guide rail includes a guide channel which extends generally along the guide rail and an entrance slot to the guide channel, and the carriage includes opposing projections which are positionable in the corresponding entrance slots and guide channels.

7. The dispenser of claim 1, wherein the edged member is a squeegee that is removably connected to the carriage.

8. The dispenser of claim 1, further comprising a valve assembly adapted to control the flow of the viscous liquid from the dispensing opening, wherein the valve assembly is mounted for movement to compensate for an increase in a length of the flexible viscous liquid containing bag caused by dispensing liquid, wherein the movement of the valve assembly is generally in a direction of the length of the flexible viscous liquid containing bag.

9. The dispenser of claim 8, wherein the valve assembly includes a first part with a V-shaped protrusion that is movable relative to a second part having a complementary shaped hollow jaw to clamp a nozzle on the flexible viscous fluid containing bag.

10. The dispenser of claim 1, further including a valve assembly, wherein the flexible viscous fluid containing bag is connected to the support plate via at least one connector such that the flexible bag is supported on the support plate and the valve assembly is connected to the bag.

11. In combination, a dispenser for dispensing a viscous liquid food product from a flexible viscous liquid containing bag and a flexible bag having an integrally formed spout and containing the viscous liquid food product, the dispenser comprising:

a support plate; and a carriage having an edged member attached thereto, the carriage being movably mounted along the support plate so that the edged member is in free pressing engagement with the flexible bag to press the flexible bag against the support plate to squeeze the viscous liquid toward the integrally formed spout, wherein the carriage is gravity driven for movement from an initial, upper position downwardly along the support plate to a lower position with the edged member in free pressing engagement with the flexible bag to constantly put the flexible bag under pressure by effect of a weight of the carriage;

the flexible bag comprising:

two flexible sides connected together around a periphery of the sides, the periphery comprising a top edge, a bottom edge and two side edges, the bottom edge including the integrally formed spout formed by the flexible sides;

the dispenser further comprising:

a connector for connecting the bag to the support plate such that the bag is supported by the support plate with the bottom edge of the bag including the integrally formed spout being located in proximity to a bottom of the support plate;

a valve assembly releasably engaged with the integrally formed spout to control the flow of the viscous liquid therefrom.

12. The combination of claim 11, wherein the valve assembly is moveably mounted to allow the valve assembly to move along with the bottom edge of the flexible bag to compensate for an increase in a length, as measured from the top edge to the bottom edge, of the flexible bag caused by the dispensing of viscous liquid from the flexible bag.

13. The combination of claim 11, further comprising:

a valve guide located in the dispenser, the valve assembly being movably connected to the valve guide; and a heater located in the dispenser to heat the viscous liquid food product.

14. The combination of claim 11, wherein the bottom edge of the bag is defined by first and second seam lines which extend inwardly from the side edges and downwardly toward the bottom of the bag, the first and second seam lines terminating at medial positions spaced apart from one another to define a spout entrance, two downwardly extending, spout forming seam lines which extend from the terminating medial positions of the first and second seam lines to define the integrally formed spout, and a spout closure seam line defined along a bottom of the spout.

15. The combination of claim 14, wherein the first and second seam lines each intersect the corresponding spout forming seam line at a point to define a crease forming transition area which functions to create a flow channel when the bag is positioned on the support plate and the spout is oriented generally downwardly.

16. The combination of claim 11, wherein hanging apertures are formed along the top edge of the bag, and valve assembly connection apertures are formed along the bottom edge of the bag.

* * * * *